United States Patent [19]

Berndt

[11] Patent Number: 4,936,514

[45] Date of Patent: Jun. 26, 1990

[54] LOW SPEED SHUT DOWN METHOD FOR HIGH TEMPERATURE HAMMER MILLS

[75] Inventor: Mitchell J. Berndt, Brea, Calif.

[73] Assignee: Union Oil Company of California, Los Angeles, Calif.

[21] Appl. No.: 267,814

[22] Filed: Nov. 7, 1988

Related U.S. Application Data

[62] Division of Ser. No. 102,861, Sep. 30, 1987, Pat. No. 4,798,343.

[51] Int. Cl.[5] ..... B02C 13/30; B02C 23/00

[52] U.S. Cl. ..... 241/30

[58] Field of Search ..... 241/30, 36, 101.2, 32, 241/189 R, 189 A, 188 R; 60/700, 716, 718; 366/601; 74/661

[56] References Cited

U.S. PATENT DOCUMENTS

| | | | |
|---|---|---|---|
| 3,820,338 | 6/1974 | Hiersig et al. . | |
| 4,484,871 | 11/1984 | Adman et al. | 74/661 X |
| 4,520,910 | 6/1985 | Eastcott et al. | 74/661 X |
| 4,545,537 | 10/1985 | Kimura et al. | 241/36 |
| 4,619,407 | 10/1986 | Goldhammer | 241/36 X |

OTHER PUBLICATIONS

Arthur F. Taggart, *Handbook of Mineral Dressing*, John Wiley & Sons, Inc., New York, 1945, pp. 4–77 through 4–87.

*Primary Examiner*—Joseph M. Gorski

*Attorney, Agent, or Firm*—Gregory F. Wirzbicki; Yale S. Finkle; William O. Jacobson

[57] ABSTRACT

Low speed shutdown apparatus for a high temperature hammer mill having a relatively high speed drive motor connected to the hammer mill drive shaft includes a low speed, high torque shutdown drive motor and a drive belt for connecting the low speed shutdown motor to the hammer mill shaft in place of the high speed drive motor. Preferably both the high speed drive motor and the low speed shutdown motor are connected to the hammer mill shaft through electrically controlled clutches, an electrical control being provided for disengaging the high speed drive motor in the event of a shutdown situation in which the hammer mill is shutdown while loaded with hot material and for engaging the low speed motor with the shaft to keep the shaft turning so as to prevent or substantially eliminate warping of the shaft due to the high temperature in the mill while the mill cools down. The low speed shutdown motor is reversible to enable the driving of the hammer mill shaft in either rotational direction selected by an operator. A corresponding method for shutting down a high temperature hammer mill is provided.

6 Claims, 1 Drawing Sheet

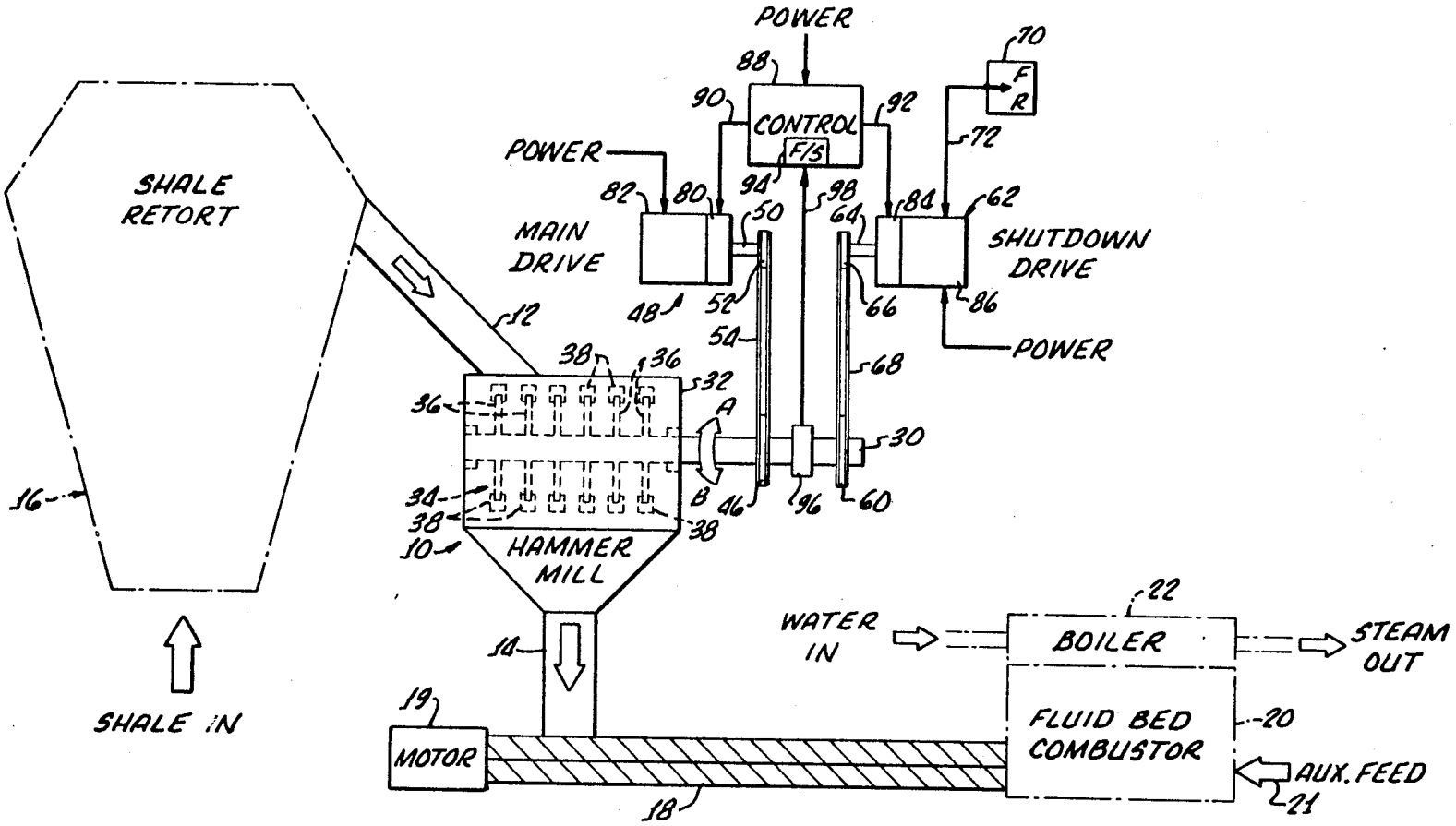
STEAM OUT
AUX. FEED
BOILER
FLUID BED COMBUSTOR
WATER IN
SHUTDOWN DRIVE
POWER
CONTROL
F/S
F
R
MAIN DRIVE
HAMMER MILL
MOTOR
SHALE RETORT
SHALE IN

LOW SPEED SHUT DOWN METHOD FOR HIGH TEMPERATURE HAMMER MILLS

CROSS REFERENCES TO RELATED APPLICATIONS

This application is a division of U.S. patent application Ser. No. 102,861, filed in the U.S. Patent and Trademark Office on Sept. 30, 1987 and now U.S. Pat. No. 4,798,343.

BACKGROUND OF THE INVENTION

1. Field of the Invention

The present invention relates generally to the field of hammer mills of the type used for crushing mineral ores and the like and more particularly to high temperature hammer mills used for such purpose.

2. Background Discussion

Hammer mills are specially constructed machines used for breaking and crushing pieces of hard, frangible materials, such as rock and mineral ores, into smaller pieces. Typical hammer mills are constructed with one or more heavy metal plates or discs to peripheral regions of which are swingingly mounted several heavy metal weights which act as hammers. These plates, with their attached hammers, are fixed to a drive shaft which is rotatably mounted within a heavy metal housing. In operation, the discs are driven by a shaft motor at relatively high angular velocity so that pieces of material fed into the mill are impacted at high velocity by the hammers. The hammers break some of these pieces of material and drive the broken pieces, as well as other, unbroken pieces, into impact with still other pieces of the material, with housing side walls and with other hammers, thereby breaking and/or further breaking the pieces. A grating installed at the bottom of the housing enables broken pieces of material smaller than the grating openings to be discharged; larger pieces are recirculated through the mill until they are broken into sufficiently small pieces to pass through the grating openings.

A more complete description of hammer mills and their operation can, for example, be found in the Handbook of Mineral Dressing, by Arthur F. Taggart, published by John Wiley and Sons, New York, 1945, pages 4–77 through 4–87, and which is incorporated herein, by specific reference, in its entirety. As described in the referenced Handbook, primary hammer mills are generally operated at a minimum rotational speed of about 550 RPM, while hammer mills used for secondary crushing are operated at speeds as high as about 3000 RPM. To this end, hammer mills are typically driven by relatively high speed motors, which usually provide a relatively low torque, and are, therefore, normally designed to be driven to full rotational speed before any material requiring fracturing into smaller pieces is fed into the machine. After being brought up to full operating speed, hammer mills are commonly kept running even during idle periods when no material is being processed by the machine. In the event of an unscheduled shutdown, due to some type of malfunction, a loaded hammer mill must normally be manually unloaded before it can be restarted, since hammer mill drive motors are typically not designed to start up a loaded machine.

INTRODUCTION TO THE INVENTION

A specific and potentially important use for large, ore-crushing types of hammer mills is for crushing retorted oil shale so the shale can be combusted, for example, for production of steam.

In this regard, retorted oil shale ordinarily still contains a sufficient amount of unretorted kerogen from which shale oil is produced and/or usually from about 4 weight percent to as much as about 20 weight percent of coke (carbon), resulting from the high temperature retorting process, for the retorted shale still to represent a valuable energy resource. One manner in which this energy can be recovered is to burn the retorted shale and generate steam which can, in turn, be used for heating and/or for electric power generation. However, the retorted shale, which typically consists of pieces ranging in size from fines to several inches across, cannot, as discharged from the retort, be readily and efficiently combusted. In order to enable efficient burning, it has been determined that the retorted shale should preferably first be reduced in size, advantageously, by the use of hammer mills, and the small, more or less uniform particles burned in a fluid bed combustor.

Further in this regard, and as an indication of the potential importance of this "salvaging" of retorted oil shale, it is instructive to observe that although oil shale represents a vast reserve of oil similar to crude oil—by estimates, as much as $5.5\times10^{12}$ barrels, as compared to world crude oil estimates of about $7\times10^{11}$ barrels—economical processes for producing oil from shale have yet to be fully developed.

The present high cost of producing oil from shale is a result of many difficult technical and environmental problems. Some of these problems are, for example, briefly discussed in the "McGraw Hill Encyclopedia of Energy," Second Edition, 1977, at pages 18, 19 and 59. Due to these difficult problems, it has consistently been more economical, at least in this country, to extract crude oil from the ground or to buy it abroad than it has been to produce oil from shale. It appeared, however, in the mid-1970's, as a result of the disruption of crude oil supplies from the Mid-East, the crude oil embargoes, the emergence of strong oil cartels and the dramatic increase in crude oil prices, that this situation might change. And at that time, greatly increased attention was directed towards exploitation of this nation's extensive oil shale reserves, particularly, the huge Eocene Green River Formation in Colorado, Wyoming and Utah. Shale oil reserves represented by this Formation alone are estimated at about twenty times the entire crude oil reserves in this country.

Although much of this interest in oil shale has since faded with the reemergence of crude oil surpluses and stabilized, lower crude oil prices, some significant efforts have nevertheless continued towards developing cost effective shale oil production processes in anticipation of the inevitable depletion of crude oil reserves. In this regard, it presently appears that when such oil shale processes are developed to the point where shale oil is competitive in price with crude oil, the processes will result from increasing the efficiency of presently known oil shale processes and reducing present oil shale energy wastage, rather than from any dramatic technology breakthroughs. As above mentioned, part of this energy wastage results from incomplete oil removal by existing, largescale, retorting processes.

The magnitude of the oil shale problems and the importance of extracting as much oil as possible from the shale can perhaps be better appreciated by considering that the production of even a relatively modest 10,000 barrels of oil a day (BPD) of shale oil requires the daily mining and processing of between about 15,000 and 20,000 tons of high grade oil shale. The present 10 to 20 percent of residual oil in retorted shale therefore represents between about 1500 and 4000 tons of shale a day at the exemplary 10,000 BPD production rate.

As mentioned above, one efficient manner of "recovering" this residual amount of oil (and the coke) in retorted shale is to burn the retorted shale in a fluid bed combustor. Preferably, for this use, the relatively large pieces of retorted shale are first reduced in size, for example, by the use of hammer mills. Moreover, it has been found advantageous to crush the retorted shale just as the shale is discharged from the retort and while it is still at retort temperature (which may be as high as about 1000° F.). Otherwise, because of the residual oil content in retorted shale and the likelihood of spontaneous combustion of the hot shale in air, costly pre-discharge cooling processes are required.

Some problems have, however, been encountered with the use of high temperature hammer mills, and particularly those requiring operation without exposing the material being crushed to air. One of these problems has been the warping of the hammer mill shaft when a system malfunction causes rotation of the shaft to stop while the hammer mill is still loaded with hot shale. When the shaft is even moderately warped, removal and straightening of the shaft is required before the hammer mill can again be used. Such shaft removal and repair is difficult and time-consuming, particularly when the hammer mill is constructed to seal out air, and the hammer mill may thus be out of service for a substantial period of time. Since an out-of-service hammer mill could severly disrupt the associated shale retorting process, costly alternatives, such as a stand-by hammer mill or shale cooling apparatus so the shale can be discharged into the air, must be provided. The cost of these alternatives may outweigh the benefits obtained by using the retorted shale to produce steam.

It has been determined by the present inventor that hammer mill shaft warping due to unscheduled shutdown of a hammer mill loaded with hot shale can be virtually eliminated by continuing to slowly rotate the shaft at several RPM while the mill cools down. However, it is not feasible to depend upon gearing down the high speed drive motor to provide such slow shaft rotation, since failure of the drive motor is one of the malfunctions which cause the hammer mill to shutdown.

Improvements to high temperature hammer mills are, therefore, needed to eliminate, or at least substantially reduce, the above-described shaft warping problem, particularly since unscheduled shutdowns of loaded shale crushing hammer mills have been found not to be uncommon occurrences because of the harsh environment. It is, therefore, a principal objective of the present invention to provide for such improvements.

SUMMARY OF THE INVENTION

The present invention provides a low speed shutdown apparatus for a high temperature hammer mill having a high speed drive connected to a drive shaft for causing the shaft, and crushing hammers connected thereto, to rotate at a relatively high operational velocity. Comprising the low speed shutdown apparatus are shutdown drive means, which may be a low speed, high torque motor, and control means for selectively connecting such shutdown drive means to the hammer mill shaft in place of the normal, high speed drive. The low speed shutdown drive means and the control means enable, in the event of a shutdown of a hammer mill which is loaded with material having a high temperature, the shaft to be kept turning at a slow speed while the hammer mill cools down and thereby prevent warping of the shaft.

According to a preferred embodiment, the control means include a first electrically operated clutch connected between the high speed drive and the hammer mill shaft and a second electrically controlled clutch connected between the shutdown drive means and the shaft, it being thereby possible to disengage the high speed drive from the shaft before the shutdown drive means are engaged with the shaft. Also, the shutdown drive means are preferably selectively reversible so that the hammer mill shaft can be driven at a slow speed in either rotational direction, depending on the nature of a malfunction causing the shutdown.

It is preferred that the control means include means responsive to the hammer mill drive shaft speed for preventing engagement of the shutdown drive means with the drive shaft unless the drive shaft speed is about the same or less than the drive shaft speed provided by the shut-down drive means.

A corresponding method for shutting down a high temperature hammer mill, including shifting from a high speed to a low speed hammer mill shaft drive, is provided.

BRIEF DESCRIPTION OF THE DRAWING

The present invention can be more readily understood from the following detailed description when taken in conjunction with the accompanying drawing which is a pictorial diagram, partially in schematic form, showing an exemplary high temperature hammer mill connected for receiving hot, retorted oil shale from an oil shale retort and showing a main, high speed drive and a secondary, low speed, shutdown drive and control means for selectively connecting the drives to a drive shaft of the hammer mill.

DESCRIPTION OF THE PREFERRED EMBODIMENT

Shown in the drawing is an exemplary, high temperature hammer mill 10 having at least one particulate matter input conduit 12 connected to upper regions thereof and a crushed material outlet conduit 14 connected to lower regions thereof. By way of example, with no limitations thereby intended or implied, input conduit 12 may be connected to a high temperature oil shale retort 16 (which is shown in the drawing in phantom lines) for receiving therefrom relatively large pieces of hot, retorted oil shale to be crushed into smaller pieces, for example, to less than about ¼ inch across, by hammer mill 10. Also by way of example, hammer mill outlet conduit 14 is shown in the drawing as being connected to a screw-type conveyor 18, driven by a motor 19, which conveys crushed material from the outlet conduit to a point of use which may be a fluid bed combustor 20 (shown in phantom lines on the drawing). There may also be fed into combustor 20, through a feed conduit 21, an auxiliary fuel, such as fuel oil or oil shale fines from a pre-retorting shale crushing operation, to initiate the combustion of the retorted shale (especially if its kerogen and coke content is low) and/or augment such combustion.

Associated with combustor 20 may be a boiler 22 (also shown in phantom lines) in which heat from combusting the shale is used to generate steam for facility heating purposes or for the production of electric power by the driving of a steam turbine-generator.

Hammer mill 10 includes a drive shaft 30 which is rotatably mounted in bearings (not shown) installed in a hammer mill housing 32. Connected to that portion of shaft 30 which is within housing 32 is a generally conventional hammer assembly 34 which may comprise a plurality of discs 36 having pivotally connected thereto hammer elements 38. The opposite, driven end region of shaft 30 extends outwardly through housing 32.

Connected to the outwardly extending end region of shaft 30 is a first or main drive belt pulley 46. A main, high speed drive assembly 48, which may comprise an electric motor and gear box, is provided having a motor drive shaft 50 to which is fixed a drive belt pulley 52. A drive belt 54 entrained over pulleys 46 and 52 transmits driving power from motor drive shaft 50, through pulleys 46 and 52, to hammer mill drive shaft 30, thereby, causing rotation of discs 36 and hammer elements 38 at their operating speeds. For example, main drive assembly 48 may drive hammer mill shaft 30 at a rotational speed of about 750 RPM in the clockwise direction indicated by arrow "A" in the drawing.

To provide low speed rotation of hammer mill shaft 30 in the event of an unscheduled shutdown, there is connected to the shaft a second or shutdown drive belt pulley 60 through which the shaft may alternatively be driven by a secondary, low speed, shutdown drive assembly or means 62, which may also comprise an electric motor and a gear box. Shut down drive assembly has a drive shaft 64 to which is fixed a drive pulley 66. Entrained over pulleys 60 and 66 is a drive belt 68 by means of which shutdown drive assembly 62 drives hammer mill shaft at a low speed of, for example, only a few RPM. A forward/reverse switch 70 is preferably connected to shutdown drive assembly 62 by a conduit 72 to thereby enable the drive assembly to rotate hammer mill shaft 30 in either rotational direction selected, according to the nature of the malfunction which causes a shutdown. As an illustration, if a piece of tramp metal jammed in hammer assembly 34 causes a shutdown, shutdown drive assembly 62 may be selected by switch 70 to rotate hammer mill shaft 30 in the direction opposite (e.g., the counterclockwise direction of arrow 'B" shown on the drawing) to the normal operating direction.

It can be appreciated that both main drive assembly 48 which rotates hammer mill shaft 30 at a relatively high speed and shutdown drive assembly which rotates the hammer mill shaft at a low speed cannot both be connected for driving the hammer mill shaft at the same time. Alternative driving of hammer mill shaft 30 by main drive assembly 48 and shutdown drive assembly 62 can be accomplished by entraining only the appropriate drive belt 54 or 68 over the corresponding pair of pulleys 46, 52 or 60, 66. Accordingly, in the event of a malfunction shutdown, drive belt 54 associated with main drive assembly 48 could be removed from pulleys 46 and 52. Then drive belt 68 associated with shutdown drive 62 could be entrained over pulleys 60 and 66 to enable shutdown drive assembly to rotate shaft 30 at a slow speed until hammer mill 10 cools down and the risk of warping the shaft has passed. As another alternative, shutdown drive assembly 62 may be positioned so that after removal of main drive belt 54 from pulleys 46 and 52, the same belt (or another belt) could be entrained over pulley 60 and pulley 66 associated with shutdown drive assembly 62.

Both of these two procedures for manually disengaging main drive assembly and engaging shutdown drive assembly have, however, the disadvantage that drive assemblies 48 and 62 have to be moved in some manner to enable drive belt removal and installation. When the appropriate drive belt has been installed, shutdown drive assembly 62 has to be moved to achieve proper tensioning of its drive belt. Such moving of drive assemblies 48 and 62 and manual belt installation may be undesirable for situations requiring rapid changeover of drives to prevent hammer mill shaft warping.

It is, therefore, generally preferred that main drive means 48 include an electric clutch 80 between a high speed, low torque motor 82 (which may include a gear box) and drive pulley 52, as shown in the drawing. In such case, an electric clutch 84 is connected between a low speed, high torque motor 86 (which may also include a gear box) of shutdown drive assembly 62 and drive pulley 66. Electric control means 88 are then connected to electric clutches 80 and 84, through respective conduits 90 and 92. Preferably control means 88 are configured so that only one of electric clutches 80 and 84 can be energized at any one time.

A shaft speed indicator 94 of control means 88 may be connected to a shaft speed detector 96, through a conduit 98, so that an operator can determine when the rotational speed of hammer mill shaft 30 has decreased, after a malfunction shutdown has been initiated, to a sufficiently low speed that shutdown clutch 84 may be safely be engaged. Such engagement of clutch 84 may, for example, be made when the speed of shaft 30 has decreased to about the drive speed of shutdown drive assembly 62. Alternatively, an internal, electronic interlock circuit (not shown) may be provided to automatically disenable the engagement of clutch 84 until the rotational speed of shaft 30 has decreased to a preselected, safe level. Such a disenabling circuit may also be configured to disenable the accidental reengagement of main drive clutch 80 when the speed of hammer mill shaft 30 is below a preselected rotational speed so as to prevent damage to hammer mill 10 and/or main drive assembly 48.

A corresponding method for shutting down a high temperature hammer mill comprises disengaging a high speed drive means from the hammer mill shaft and engaging a low speed drive means in lieu thereof to the shaft. The method further comprises operating clutches between the high speed drive means and the shaft and between the low speed shutdown drive means and the shaft, and also includes selectively establishing the direction in which the shutdown drive means will drive the shaft.

Although there has been described above a specific arrangement of a slow speed shutdown apparatus, and a corresponding shutdown method, which may be used with a high temperature hammer mill, for the purpose of illustrating how the invention may be used to advantage, it is to be understood that the invention is not so limited Accordingly, any and all variations and modifications which may occur to those skilled in the art are to be considered to be within the scope and spirit of the invention as defined in the appended claims.

What is claimed is:

1. A method for shutting down a hammer mill which has a drive shaft for rotating the hammer mill connected to a high speed drive means causing said drive shaft to rotate in a rotational direction at a relatively high speed, and said drive shaft being connectable to a low speed shutdown drive means for providing a low drive shaft rotational speed relative to the speed at which the drive shaft is driven by the high speed drive means at normal operating conditions, the method comprising the steps of:

a. disengaging said high speed drive means from said drive shaft; and b. engaging said shutdown drive means with said drive shaft thereby causing said drive shaft to be turned at said relatively low speed.

2. The method of claim 1 wherein said shutdown drive means provides a high torque relative to the torque provided to the drive shaft by the high speed drive means at normal operating conditions.

3. The method of claim 2 which also comprises the step of:

c. reversing the rotational direction of said shutdown drive means.

4. The method of claim 2 which also comprises an initial step of selecting the rotational direction in which the shutdown drive means rotates said drive shaft.

5. The method of claim 2 which also comprises the initial steps of:

i. connecting a first selectively operable clutch between the high speed drive means and said drive shaft; and ii. connecting a second selectively operable clutch between the shutdown drive means and said drive shaft.

6. A method for shutting down an apparatus for breaking up pieces of frangible material into smaller pieces and normally operating at a temperature above ambient, said apparatus having an operating drive means connected to a drive shaft causing said drive shaft to rotate at a first speed, and having a shutdown drive means for causing said drive shaft to rotate at a second speed, wherein said second speed is low relative to the first speed at which the drive shaft is driven by the operating drive means at normal operating conditions, the method comprising the steps of:

a. disengaging said operating drive means from said drive shaft; and b. engaging said shutdown drive means to said drive shaft, thereby causing said drive shaft to be turned at said second speed.

* * * * *